United States Patent [19]

Wills

[11] 4,302,651

[45] Nov. 24, 1981

[54] HIGH-VOLTAGE SCR CIRCUIT FOR MICROWAVE OVEN AND THE LIKE

[75] Inventor: Walter L. Wills, Mesquite, Tex.

[73] Assignee: Varo Semiconductor, Inc., Garland, Tex.

[21] Appl. No.: 50,803

[22] Filed: Jun. 21, 1979

Related U.S. Application Data

[63] Continuation of Ser. No. 855,936, Nov. 30, 1977, abandoned.

[51] Int. Cl.[3] ..... H05B 6/66

[52] U.S. Cl. ..... 219/10.55 B; 307/252 L; 331/86; 323/323

[58] Field of Search ..... 219/10.55 B; 307/252 L, 307/252 Q, 252 K; 323/8, 24, 323; 331/86, 87, 185, 186; 315/105

[56] References Cited

U.S. PATENT DOCUMENTS

| | | | |
|---|---|---|---|
| 3,310,777 | 3/1967 | Fosdick | 307/252 L |
| 3,502,910 | 3/1970 | Johanson-Brown | 307/252 L |
| 3,546,488 | 12/1970 | Motto, Jr. | 307/252 L |
| 3,599,075 | 8/1971 | Etter et al. | 307/252 L X |
| 3,633,046 | 1/1972 | Dewey | 307/252 L |
| 3,772,532 | 11/1973 | Petrov et al. | 307/252 L |
| 3,886,432 | 5/1975 | Piccone et al. | 307/252 L |
| 4,001,537 | 1/1977 | Burke et al. | 219/10.55 B |
| 4,012,617 | 3/1977 | Burke et al. | 219/10.55 B |
| 4,041,267 | 8/1977 | Wechsler | 219/10.55 B |
| 4,121,149 | 10/1978 | Seltzer | 219/10.55 B |

OTHER PUBLICATIONS

G. I. Astaf'ev et al., Lenin Metallurgical Combine, Zavodskaya Laboratoriya, vol. 39, No. 12, pp. 1535–1536, 12/1973.

*Primary Examiner*—Richard R. Kucia
*Assistant Examiner*—Philip H. Leung
*Attorney, Agent, or Firm*—John S. Fosse

[57] ABSTRACT

An SCR circuit is provided in a high-voltage supply for energizing a magnetron that is assembled in a microwave oven. The high-voltage supply circuit includes a voltage step-up transformer. This transformer is arranged with a low-voltage secondary winding which is connected across the heater-cathode electrode of the magnetron and a high-voltage secondary winding which is coupled in series with a capacitor. The series combination of the capacitor and the high-voltage secondary is connected across the cathode and anode electrodes of the magnetron; and importantly, the high-voltage SCR circuit includes a number of series-connected SCR's electrically in shunt of the magnetron. A triggering circuit gates the high-voltage SCR circuit to the current-conducting state during a selected phase portion of an applied AC potential, in order to control the amount of power being supplied to the magnetron. The high-voltage SCR circuit also advantageously includes a diode and a coil disposed in electrical series with the series-connected SCR's respectively to cooperate with the SCR's in blocking reverse voltage and to limit the rate of current rise in the forward direction. A coupling circuit is associated with the gate terminal of each of the individual SCR's for coupling the triggering circuit gating signal to all of the SCR gates simultaneously, while preventing current leakage back through the coupling circuits.

4 Claims, 3 Drawing Figures

HIGH-VOLTAGE SCR CIRCUIT FOR MICROWAVE OVEN AND THE LIKE

This is a continuation of application Ser. No. 855,936, filed Nov. 30, 1977, now abandoned.

BACKGROUND OF THE INVENTION

This invention relates generally to high-voltage SCR arrangements and more particularly to a high-voltage SCR circuit that is incorporated in a high-voltage supply for energizing a magnetron of the type commonly employed in a microwave oven.

Microwave ovens have been developed as domestic appliances for heating and cooking foods by exposure to the energy of microwave radiations. According to modern commercial practice, these domestic microwave ovens employ a magnetron, basically an electronic vacuum tube which converts a DC electrical input into an electromagnetic output in the microwave frequency range. Magnetrons of this type generally include a cathode-heater electrode and an anode electrode and exhibit a unidirectional current carrying characteristic. Such a magnetron further requires a DC potential across the electrodes of on the order of 3000 to 5500 volts to bias the tube into conduction for producing the microwave energy.

In the past, high-voltage power supplies for providing this operating potential ordinarily have included a transformer for stepping up conventional household 120-volt AC line power, together with a rectifier and doubler circuit for generating the required level of DC voltage. Generally, a separate source of low-voltage AC potential is supplied to the heater electrode of the magnetron.

Adjustability of the microwave power level is both desirable and a user convenience; and according to one conventional practice, microwave oven power supplies have been provided with a high leakage reactance transformer and a halfwave voltage doubler or villard circuit. The latter circuit comprises a high-voltage capacitor in series with the high-voltage secondary coil of the transformer and a high-voltage rectifier for blocking reverse current to the capacitor. Moreover, various circuits have been employed heretofore as a control in the primary of the transformer for regulating the amount of current applied thereto, thereby affording a degree of regulation over the power being delivered by the secondary and doubler circuit to the magnetron tube and, consequently, a degree of control over the microwave power output. An alternative prior art control arrangement utilizes a capacitor having two selectable values as the series capacitance of the villard circuit or voltage doubler, thereby providing two selectable power levels to the magnetron. Another control arrangement relies on a variable resistor in the current path to the magnetron for adjusting the amount of current supplied thereto. In the former case, only two selectable power levels are available. Moreover, the special dual value capacitor is a relatively expensive device. In the latter case, a limited range of adjustment is available, and considerable power must be dissipated in the resistor. This requires a relatively expensive resistor and one which is capable of consuming a relatively large current. As will be appreciated the consumption of current generates undesirable heat; and this may have a deleterious effect on other circuit components.

A further prior art arrangement for variable control of the microwave output electrically connects a semiconductor triac is joined to a triggering circuit adapted for selectively varying the portion of the AC cycle during which the triac goes into conduction. The triggering circuit is fed by an additional low-voltage tap on the high-voltage secondary of the transformer and includes either an RC phase shifting network and a semiconductor diac in series between the transformer tap and the control terminal of the triac or, alternatively, a multivibrator circuit connected between the tap and the triac control terminal. In the case of a multivibrator, an additional diode is required in series with the triac. This arrangement therefore contemplates a number of added circuit elements and devices as well as a transformer with a supplementary low-voltage tap on the high-voltage secondary, thus adding considerably to the expense and labor required to produce the high-voltage magnetron supply.

OBJECTS AND SUMMARY OF THE INVENTION

A general object of the present invention is to provide a new and improved high-voltage circuit for supplying selected, different amounts of power to a microwave magnetron tube.

A more specific object of this invention is to provide a high-voltage circuit of the type described which eliminates the need for either a high-voltage rectifier or a separate filament transformer for heating the cathode-heater electrode of the magnetron tube.

Another object of this invention is to provide a high-voltage SCR circuit for use in a high-voltage supply circuit, which SCR circuit is relatively simple and inexpensive, can be produced as a unit to facilitate its connection in the high-voltage circuit, and yet is rugged and reliable in operation.

Yet another object of this invention is to provide a high-voltage SCR circuit in accordance with the foregoing object, which is capable of handling a considerably higher range of voltage than a conventional SCR in both the forward and reverse direction, and is responsive to a trigger or gate pulse for going into conduction, yet is highly efficient in blocking large reverse voltages and is relatively free of leakage current therethrough in response to forward voltage, in the absence of a trigger or gate pulse.

Briefly, and in accordance with the foregoing objects, a high-voltage SCR circuit includes a plurality of individual SCR's connected electrically in series. Coupling circuit means are joined to the gate terminals of each of the plurality of SCR's for simultaneously coupling a trigger pulse thereto while substantially preventing leakage current through the circuit.

In a preferred embodiment, DC reverse blocking means are provided in series with the plurality of SCR's to cooperate in opposing an applied reverse voltage. Also, in another preferred embodiment, limiting means are provided in series with the plurality of SCR's to restrict the rate of rise of applied current in the forward direction.

Other objects, features and advantages of the present invention will become apparent upon a consideration of the following detailed descriptions, together with the accompanying drawing wherein like reference numerals are used throughout to designate like elements and components.

DETAILED DESCRIPTION OF THE ILLUSTRATED EMBODIMENT

Figure 1:
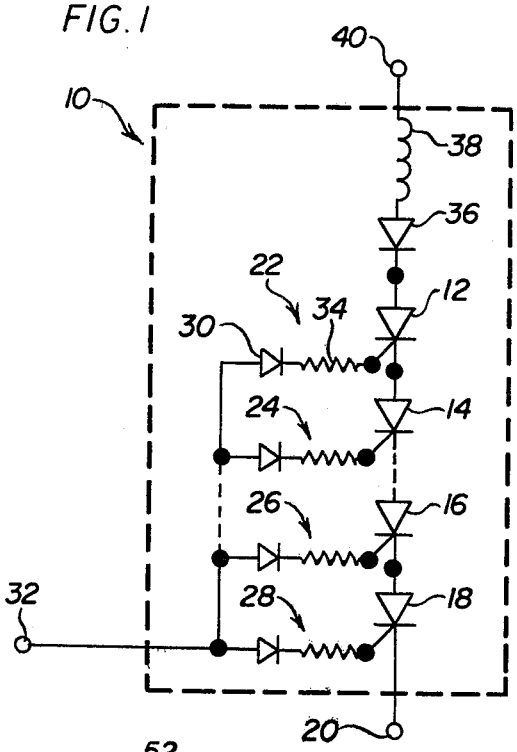
FIG. 1 is a schematic circuit diagram showing a high-voltage SCR circuit arranged in accordance with the present invention.

Referring now in detail to the drawing and initially to FIG. 1, a high-voltage SCR circuit indicated generally by the reference numeral 10 is shown to include a selected number of substantially similar individual SCR's 12, 14, 16 and 18 that are electrically in series. In particular, the cathode of SCR 12 is joined to the anode of SCR 14 the cathode of which is joined to the anode of SCR 16 and so on in the series, the cathode of the final SCR 18 comprising a cathode terminal 20 of the entire high-voltage SCR circuit 10. As illustrated in FIG. 1, the high-voltage SCR circuit 10 includes at least four individual SCR's. However, in accordance with the principles of this invention, as few as two or as many as ten or more similar, series-connected individual SCR's may be utilized as is required by the level of the voltage to be handled in a particular application.

In accordance with a feature of this invention, gating or coupling circuits 22, 24, 26 and 28 are associated respectively with the individual SCR's 12, 14, 16 and 18. The gating or coupling circuits 22–28 are substantially identical. Thus, only the coupling circuit 22 associated with the SCR 12 need be described in detail.

The coupling circuit 22 includes a diode 30 whose anode is connected with the anodes of the diodes of the other gating circuits and to a common terminal 32 which may be termed the trigger terminal of the high-voltage SCR circuit 10. The cathode electrode of the diode 30 is fed in series with a resistor 34 to the gate electrode of the SCR 12. The resistor 34, as well as the like resistor in each of the coupling or gating circuits 22–28, has its value chosen to limit the gate circuit current to a desirable level. These resistors (e.g. resistor 34) are also chosen so as to make each gate circuit 22–28 of sufficiently high impedance to allow turn-on of the succeeding SCR (i.e., SCR 12, 14, 16 or 18).

In a preferred arrangement, the high-voltage SCR circuit 10 additionally includes a DC reverse blocking element comprising a diode 36 electrically connected in series with the plurality of SCR's 12–18. Specifically, the anode and cathode electrodes of the diode 36 are oriented in the same polarity configuration as the anodes and cathodes of the individual SCR's 12–18. So arranged, the diode 36 cooperates with the SCR's 12–18 in blocking reverse DC voltage.

Moreover, a rate of current rise limiting element, specifically a coil 38, is joined electrically in series with the diode 36 and the SCR's 12–18. The remote end of coil 38 defines a terminal 40 of the high-voltage SCR circuit 10 and may be characterized as the anode terminal thereof. It will be appreciated that the coil 38 tends to limit the rate of current rise in the forward direction, thus preventing damage to the SCR's 12–18 as a result of a rapid change in current, such as might occur during SCR breakdown upon exposure to overvoltage.

It will also be appreciated that the diodes in the respective coupling or gating circuits 22–28, such as the diode 30, substantially prevent current leakage between the anode 40 and cathode 20 of the circuit 10 at high voltage levels. Specifically, it has been found that without such diodes, leakage current is often experienced at high voltages, emanating from the anode of the first SCR 12, through the gate or coupling circuit 22 down to the gate of the last SCR 18 and through its cathode, thus effectively short-circuiting the intervening SCR's. The addition of diodes, such as the diode 30, substantially prevents current flow in this direction.

Figure 2:
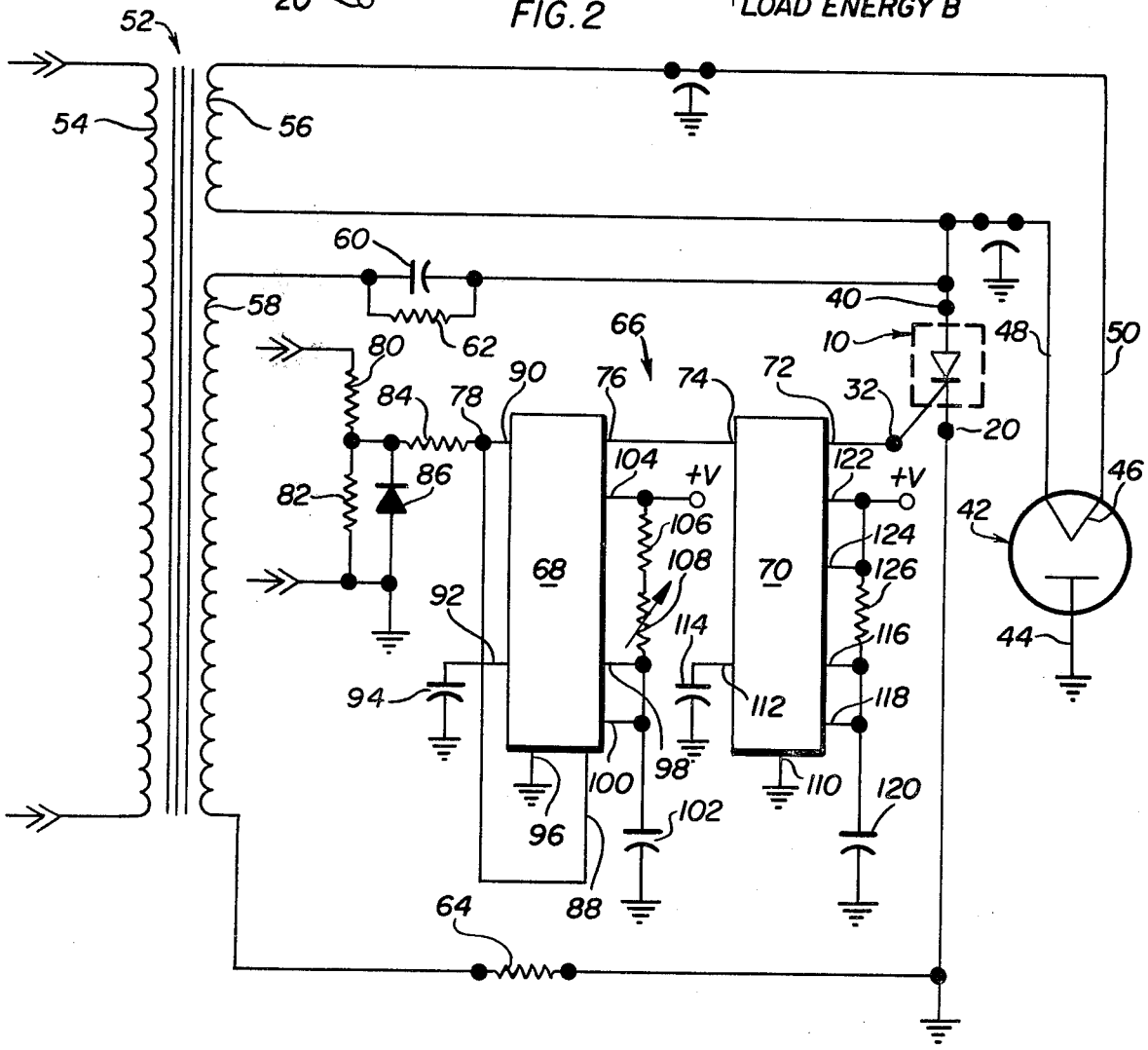
FIG. 2 is a schematic circuit diagram of a high-voltage supply circuit arranged in accordance with this invention to include the SCR cirucit of FIG. 1, for delivering controlled power to a microwave magnetron tube.

One important use of the high-voltage SCR circuit 10 is in high-voltage supply circuits where it is desired to control the amount of power supplied to a load. As a specific example, and as illustrated in FIG. 2, the SCR circuit 10 may be advantageously utilized in a high-voltage circuit for a microwave magnetron tube 42 of a microwave oven. It is not intended to limit the applications and uses of the high-voltage SCR circuit 10 of this invention by making reference to the exemplary application.

Turning now in detail to FIG. 2, the microwave magnetron tube 42 includes and anode electrode 44 which is electrically grounded and a heater-cathode electrode 46 which is joined across a pair of leads 48, 50. The high-voltage SCR circuit 10, illustrated in detail in FIG. 1, is connected electrically in shunt of the magnetron tube 42, the anode terminal 40 of the high voltage SCR circuit 10 being joined with the lead 48 and the cathode terminal 20 thereof being coupled to ground. The coil 38 and diode 36 of the high-voltage SCR circuit 10 find special advantage in this application. However, in other applications, these elements may be omitted if desired.

The high-voltage circuit illustrated in FIG. 2 advantageously includes a transformer 52 comprising a primary coil 54, a low-voltage secondary coil 56, and a high-voltage secondary coil 58. The low-voltage secondary coil 56 is connected across the leads 48, 50 of the heater-cathode electrode 46 to provide a suitable low-voltage AC current thereto for heating purposes. Briefly, it will be appreciated that the magnetron tube comprises a vacuum tube device which requires some heating of its cathode in order to release sufficient electrons for proper operation. It will also be noted that, in this regard, many prior art high-voltage circuits require a separate filament transformer for this purpose. The present invention effectively eliminates the need for this extra component.

Continuing with reference to FIG. 2, the high-voltage secondary coil 58 is joined at one side to a capacitor 60 that is in series relationship with the lead 48 of the heater-cathode electrode 46; and a shunt resistor 62 is provided across the capacitor 60. The opposite side of the high-voltage secondary coil 58 is connected via a resistor network 64 to ground.

In accordance with a feature of this invention, a triggering circuit designated generally by the numeral 66 feeds the gate or trigger terminal 32 of the high-voltage SCR circuit 10. The trigger circuit 66 itself includes a pair of timer integrated circuits 68, 70 that are connected in sequence with the terminal 32. Specifically, an output terminal 72 of the timer circuit 70 is connected with the terminal 32, while an input terminal 74 thereof is connected with an output terminal 76 of the timer circuit 68. An input terminal 78 of the timer circuit 68 is fed from a suitable source of AC power, such as the AC power source connected across the primary coil 54 of the transformer 52. Specifically, a voltage divider, comprising a pair of resistors 80, 82 and a current limiting resistor 84, is connected between the AC source and the input terminal 78 of the timer circuit 68. A diode 86 has its cathode electrode joined to the junction of the resistors 80 and 82 and its anode electrode coupled to ground. The timer integrated circuits 68 and 70 are preferably of the type designated generally "555".

The timer integrated circuit 68 includes a trigger terminal 88 and a reset terminal 90 connected together at the terminal 78. The circuit 68 also includes a control voltage terminal 92 connected via a capacitor 94 to ground, a reference terminal 96 joined directly with ground, a discharge terminal 98, and threshold terminal 100 that is connected via a capacitor 102 to ground. A positive DC voltage is empressed on a terminal 104 of the timer circuit 68 and on a resistor 106 which is connected in series with a variable resistor or potentiometer 108, resistors 106 and 108 being connected, in turn, between the terminal 104 and the terminal 98 of the timer integrated circuit 68.

With reference to the timer integrated circuit 70, a ground terminal 110 thereof is connected to ground, a control voltage terminal 112 is connected via a capacitor 114 to ground; and discharge and threshold terminals 116 and 118 are coupled to ground via a capacitor 120, in similar fashion to the timer circuit 68. In addition the input terminal 74 of the timer circuit 70 comprises its trigger terminal, while a reset terminal 122 is connected in common with a voltage supply terminal 124 to a source of positive DC potential. A resistor 126 is desirably connected between the voltage supply terminal 124 and the discharge terminal 116.

In operation, the trigger circuit 66 functions substantially as follows. The timer integrated circuit 68 responds to a triggering signal applied at the terminal 78 by producing an output pulse of predetermined amplitude and duration. The amplitude of the output pulse is determined by the value of the DC voltage supplied at the terminal 104. The duration of the output pulse is determined, in turn, by the values of the fixed resistor 106, the variable resistor 108, and the capacitor 102.

The timer integrated circuit 70 functions as a monostable circuit and in similar fashion as described for the timer integrated circuit 68. Specifically, responsive to the falling edge of the output pulse from the timer circuit 68, at the input terminal 74, the timer circuit 70 produces a pulse output at the terminal 72; and this pulse is fed to the gate or trigger terminal 32 of the high-voltage SCR circuit 10. The duration of the output pulse minimum at the terminal 72 is determined by the values of the fixed resistor 126 and the capacitor 120. The amplitude of the output pulse is dependent upon the value of the positive DC potential applied to the terminal 122.

It will be appreciated from the foregoing description, that a trigger pulse will be applied to the trigger or gate terminal 32 of the high voltage SCR 10 at a predetermined point in the phase of each cycle of the AC signal appearing at the input of the triggering circuit 66; and the variable resistor or potentiometer 108 effectively provides an adjustment for selecting the point in the phase of the AC cycle at which the trigger pulse will be produced.

It will be apparent that the high-voltage SCR circuit 10 functions in the manner of a single SCR of high value, which is to say that the circuit 10 behaves as a rectifier upon voltage being applied in the reverse direction, that is with a positive potential at the terminal 20 with respect to the terminal 40, and behaves as an electronic switch and a rectifier in series in the forward direction, that is with the potential positive at the terminal 40 with respect to the terminal 20.

With the gate or trigger current at the terminal 32 at null, a relatively high breakover voltage value is necessary to cause the circuit 10 to go into conduction with current flowing from anode to cathode. In the presence of the trigger or gate pulse at the terminal 32, however, the SCR circuit 10 readily goes into conduction. The circuit 10 functions unidirectionally, effectively blocking the flow of any current in the opposite direction, that is from the terminal 20 to the terminal 40. The provision of the diode 36 aids in such reverse blocking, as previously described. With the gate or trigger signal applied thereto, the circuit 10 will continue to conduct in the direction between the terminal 40 and terminal 20 as long as positive potential is present at the terminal 40 with respect to the terminal 20. Thus, on the presence of the positive AC half-cycle at the terminal 40 via the capacitor 60, conduction will continue from the point in the phase of the AC cycle at which the trigger pulse is applied to the terminal 32 until the beginning of the following negative AC half-cycle, as illustrated by FIG. 3.

Figure 3:
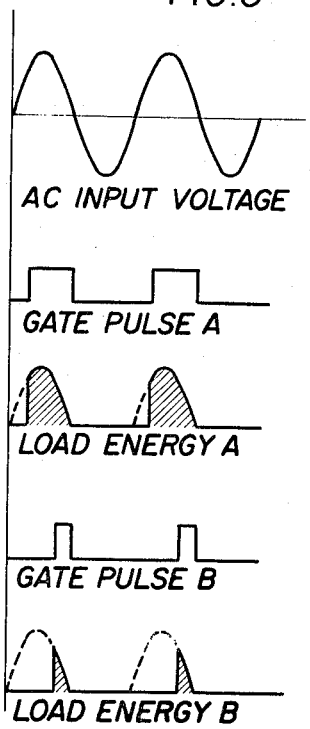
FIG. 3 is a waveform diagram illustrating the cooperation of the high-voltage SCR circuit and triggering circuit of the invention.

Turning now more specifically to FIG. 3, the energy supplied to the capacitor 60 is dependent upon the proportion of the positive AC half-cycle during which the SCR circuit 10 is conducting. If the potentiometer 108 is adjusted to produce a gate pulse relatively early in the AC positive half-cycle, a correspondingly higher amount of energy will be supplied to the load, capacitor 60, while a comparatively lower amount of energy is supplied to the load, capacitor 60 when the potentiometer 108 is adjusted to produce the gate pulse later in the AC positive half-cycle. The shaded portions of the diagram illustrate the amounts of energy supplied in each instance.

It will be appreciated that the magnitude of the DC charge or potential on the capacitor 60 will be dependent upon the energy supplied thereto in the positive AC half-cycle from the high-voltage secondary 58 during the periods of conduction of the high-voltage SCR circuit 10. The voltage across the secondary 58 during the negative half of the AC cycle is blocked by the SCR circuit 10, and therefore is additive to the capacitor voltage with respect to the magnetron 42. Consequently, the amount of power supplied to the magnetron 42 varies in accordance with the power supplied to the capacitor, thereby controlling the amount of microwave energy ultimately produced. Thus, the variable resistor 108 functions as a control for selecting the amount of resultant microwave energy. In other words, the provision of the high-voltage SCR circuit 10 and trigger circuit 66 as described provides an adjustable control for the microwave power delivered to a microwave oven with which the magnetron tube 42 is associated. Since this power control is obtained in the secondary of the power transformer, there is little effect thereof on the voltages or power available at the heater winding 56 as often occured in prior art devices wherein the power control was located in the primary coil 54 of the transformer 52, whereby many prior art designs required separate filament or heater transformers.

What has been shown and described herein is a high-voltage SCR circuit that is useful in many applications for alternatively gating or blocking current in voltage ranges considerably higher than heretofor possible with the use of a single SCR semiconductor device. The circuit is particularly advantageous when used with the trigger circuit according to this invention for controlling the amount of power delivered to a load, as for example in the illustrated microwave magnetron high-voltage supply circuit. Moreover, the provision of the SCR circuit 10 as a unit, having only three external terminals (20, 32 and 40) facilitates its interconnection in any desired application.

The specific examples illustrated and described herein are to be taken as exemplary only. Various changes beyond the embodiments described may occur to those skilled in the art and are to be understood as forming a part of a the present invention insofar as they fall within the spirit and scope of the appended claims.

The invention is claimed as follows:

1. A high-voltage circuit for energizing a microwave magnetron having an anode electrode and anode terminal, a heater-cathode electrode and a pair of heater-cathode terminals and operative to generate microwave frequency energy in response to application of a predetermined electrical potential of positive polarity at the anode electrode with respect to the cathode electrode thereof, said high-voltage circuit comprising: a transformer including a primary winding, a low-voltage secondary winding and a high-voltage secondary winding, said low-voltage secondary winding being joined across the pair of heater-cathode terminals of said magnetron for supplying current thereto, said high-voltage secondary winding stepping up the voltage from said primary winding to a predetermined voltage less than the operating potential of said magnetron; an AC source for feeding said primary; capacitor means electrically connected in series with said high-voltage secondary winding and with one of said heater-cathode terminals; high-voltage unidirectional electronic switching circuit means having first and second current conducting terminals and a triggering terminal and responsive to a triggering pulse applied to said triggering terminal for conducting current in a predetermined direction between said first and second current conducting terminals and returning to a non-conductive state in response to the current therethrough reducing to a preselected value, said switching circuit means being connected electrically in shunt of said magnetron; triggering circuit means connected between said AC source and said triggering terminal for producing said triggering pulse at a predetermined point in the phase of each AC cycle of said AC source, whereby the amount of power delivered to said capacitor for energizing said magnetron is controlled in accordance with said current conducting of said switching circuit means, wherein said triggering circuit means includes means for selectively adjusting said point in the phase of the AC cycle at which said triggering pulses are produced, and wherein said triggering circuit means comprises first and second timing circuit means, each having input terminal means, output terminal means and control terminal means; voltage and current limiting means and rectifier means connected between said AC source and the input terminal means of said first timing circuit means for delivering a voltage and current of predetermined polarity and magnitude thereto; adjustable means disposed at said control terminal means of the first timing circuit means to cause said first timing circuit means to produce an output pulse at its output terminal means during a selected portion of the phase of said AC source, said input terminal means of the second timing circuit means being connected to receive said output pulse and said control terminal means being connected for operating said second timing circuit means as a monostable circuit for producing an output pulse comprising said triggering pulse of predetermined duration on said output terminal means thereof in response to said output pulse of said first timing circuit means, said triggering terminal being connected with said second output terminal means to receive said output pulse.

2. A high-voltage circuit according to claim 1 wherein said electronic switching circuit means comprises a plurality of silicon controlled rectifiers electrically connected in series; current rate limiting means connected in series with said plurality of silicon controlled rectifiers for substantially preventing damage thereto as a result of changes in the rate of current therethrough; reverse voltage blocking means connected in series with said silicon controlled rectifiers for cooperating therewith to block reverse voltage, said series connected plurality of silicon controlled rectifiers being arranged with their anode and cathode electrodes in reverse polarity with respect to the anode and cathode terminals of said magnetron; and a plurality of coupling circuit means each connected to the gate electrode of one of said plurality of silicon controlled rectifiers, and each said coupling circuit means being connected electrically in series between the associated gate electrode and said triggering terminal for simultaneously coupling said triggering pulse to said silicon controlled rectifier gates while substantially preventing leakage current in shunt of any of said plurality of series connected silicon controlled rectifiers.

3. A high-voltage circuit according to claim 2 wherein said current rate limiting means comprises an inductor.

4. A high-voltage circuit according to claim 2 wherein said reverse voltage blocking means comprises a diode arranged with its anode and cathode in the same polarity as the anodes and cathodes of said plurality of silicon controlled rectifiers.

* * * * *